US010456616B2

(12) United States Patent
Boysen

(10) Patent No.: US 10,456,616 B2
(45) Date of Patent: Oct. 29, 2019

(54) DEVICE FOR MODIFYING GRIPS FOR WEIGHTS

(71) Applicant: Cole Boysen, Olympia, WA (US)

(72) Inventor: Cole Boysen, Olympia, WA (US)

( * ) Notice: Subject to any disclaimer, the term of this patent is extended or adjusted under 35 U.S.C. 154(b) by 0 days.

(21) Appl. No.: 15/461,403

(22) Filed: Mar. 16, 2017

(65) Prior Publication Data

US 2018/0264313 A1 Sep. 20, 2018

(51) Int. Cl.
*A63B 21/00* (2006.01)
*A63B 21/072* (2006.01)

(52) U.S. Cl.
CPC ..... *A63B 21/4035* (2015.10); *A63B 21/0724* (2013.01); *A63B 21/0726* (2013.01)

(58) Field of Classification Search
CPC ..... A63B 21/08; A63B 21/4035; A63B 21/072–075
See application file for complete search history.

(56) References Cited

U.S. PATENT DOCUMENTS 9,090 A * 9/1835 Tustin ..... A63B 22/14 482/147
4,173 A * 9/1845 Elliot ..... A63B 21/02 482/130
3,595,582 A * 7/1971 Chapman ..... A63B 53/0487 473/244
6,183,400 B1 * 2/2001 Pope ..... A63B 21/4019 16/422
2008/0040891 A1 * 2/2008 Tyler ..... A63B 21/4035 16/421
2009/0275448 A1 * 11/2009 Fishman ..... A63B 21/072 482/139
2011/0130257 A1 * 6/2011 Hartman ..... A63B 15/00 482/139
2011/0256992 A1 * 10/2011 Grafman ..... A63B 71/14 482/139
2012/0129664 A1 * 5/2012 Perry ..... A63B 71/14 482/139
2016/0096061 A1 * 4/2016 Sanders ..... A63B 21/0555 482/122
2016/0158594 A1 * 6/2016 Penney ..... A63B 21/4035 482/139

* cited by examiner

*Primary Examiner* — Nyca T Nguyen
(74) *Attorney, Agent, or Firm* — George A. Leone; Citadel Patent Law

(57) ABSTRACT

The present invention consists essentially of a sloping grip. The grip includes a receiving portion into which the handle of a dumbbell, barbell, Olympic bar, or other weight can be inserted. The grip may be higher and wider at one end, and lower and narrower at the other end, changing the angle between the user's hand and the handle of the weight. The low end is configured to transition easily to the weight handle. The grip may be comprised of rigid materials, such as plastics or woods, substantially rigid materials, such as more flexible plastics, foams, and silicones, or more flexible materials such as less dense silicones, foams, and plastics. The grip may be substantially solid or substantially hollow, depending on materials used. The grip may be formed such that the slope made by the upper surface is anywhere from 1° to 89° to the plane of the weight handle.

10 Claims, 3 Drawing Sheets

DEVICE FOR MODIFYING GRIPS FOR WEIGHTS

FIELD OF THE INVENTION

This invention relates generally to fitness, and more specifically to weight lifting devices.

BACKGROUND OF THE INVENTION

Augmenting or altering the way in which a weight is held by a user can improve or change the way the muscle is worked when the weight is lifted. For instance, some users may arch their backs while on a bench press, changing which muscles are targeted during the lift and improving overall fitness and muscle tone. The present invention aims to alter the angle at which a weight is held in the hands of a user, thereby altering the muscle areas targeted and leading to better muscle mass improvement.

SUMMARY OF THE INVENTION

This invention relates generally to fitness, and more specifically to weight lifting devices.

The present invention consists essentially of a sloping grip. The grip includes a receiving portion into which the handle of a dumbbell, barbell, Olympic bar, or other weight can be inserted. The grip is wider at one end and narrower at the other end, changing the angle between the user's hand and the handle of the weight. Ideally the angle of the grip will be between ten and forty-five degrees to the plane of the handle, but it may be as high as sixty degrees, or lower than ten degrees.

In one embodiment, the grip may be substantially rigid, in which the receiving portion would be just flexible enough to snap onto the handle while forming a tight grip on the handle. In other embodiments, the grip may be semi-rigid, such that it compresses slightly during use, while still providing the angle alteration necessary to achieve the desired result. The grip may, in some embodiments, include one or more magnetic elements to assist in the removable coupling between the grip and the handle.

In addition to the foregoing, various other methods, systems and/or program product embodiments are set forth and described in the teachings such as the text (e.g., claims, drawings and/or the detailed description) and/or drawings of the present disclosure.

The foregoing is a summary and thus contains, by necessity, simplifications, generalizations and omissions of detail; consequently, those skilled in the art will appreciate that the summary is illustrative only and is NOT intended to be in any way limiting. Other aspects, embodiments, features and advantages of the device and/or processes and/or other subject matter described herein will become apparent in the teachings set forth herein.

BRIEF DESCRIPTION OF THE DRAWINGS

Certain embodiments of the present invention are described in detail below with reference to the following drawings.

DETAILED DESCRIPTION

This invention relates generally to fitness, and more specifically to to weight lifting devices.

Specific details of certain embodiments of the invention are set forth in the following description and in FIGS. 1-4 to provide a thorough understanding of such embodiments. The present invention may have additional embodiments, may be practiced without one or more of the details described for any particular described embodiment, or may have any detail described for one particular embodiment practiced with any other detail described for another embodiment.

Importantly, a grouping of inventive aspects in any particular "embodiment" within this detailed description, and/or a grouping of limitations in the claims presented herein, is not intended to be a limiting disclosure of those particular aspects and/or limitations to that particular embodiment and/or claim. The inventive entity presenting this disclosure fully intends that any disclosed aspect of any embodiment in the detailed description and/or any claim limitation ever presented relative to the instant disclosure and/or any continuing application claiming priority from the instant application (e.g. continuation, continuation-in-part, and/or divisional applications) may be practiced with any other disclosed aspect of any embodiment in the detailed description and/or any claim limitation. Claimed combinations which draw from different embodiments and/or originally-presented claims are fully within the possession of the inventive entity at the time the instant disclosure is being filed. Any future claim comprising any combination of limitations, each such limitation being herein disclosed and therefore having support in the original claims or in the specification as originally filed (or that of any continuing application claiming priority from the instant application), is possessed by the inventive entity at present irrespective of whether such combination is described in the instant specification because all such combinations are viewed by the inventive entity as currently operable without undue experimentation given the disclosure herein and therefore that any such future claim would not represent new matter.

Figure 1:
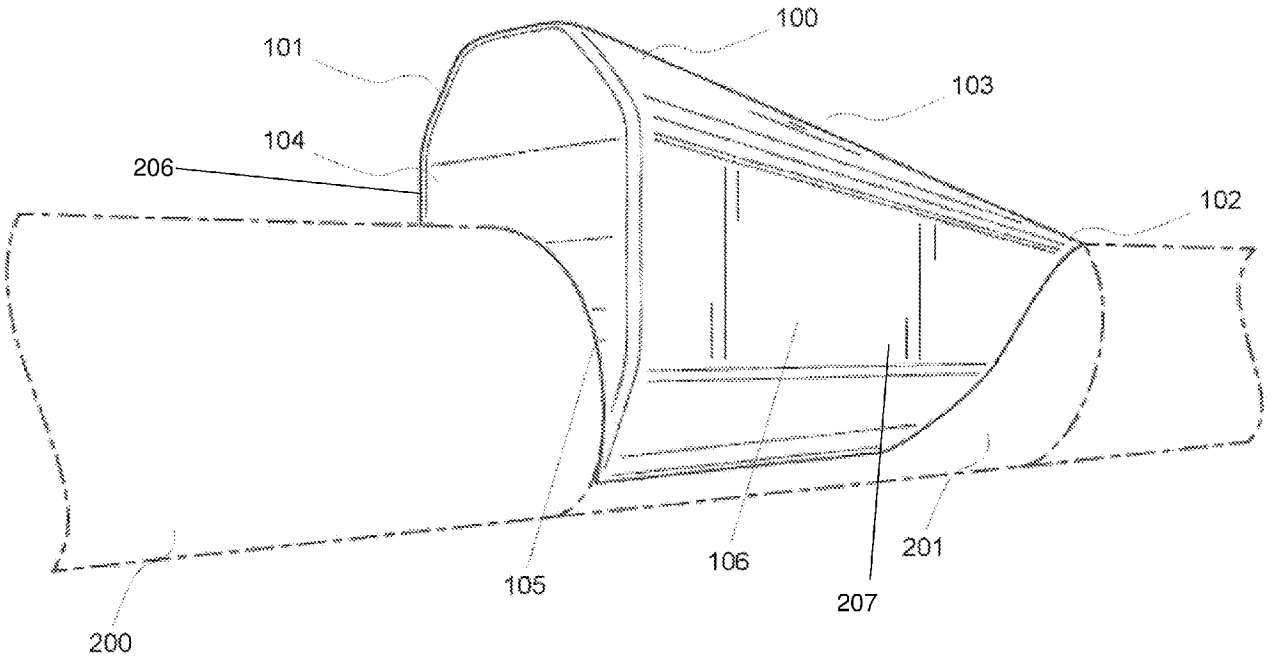
FIG. 1 is an isometric environmental view of one embodiment of the WEIGHT GRIP on a weight handle.

FIG. 1 is an isometric environmental view of one embodiment of the weight grip 100 in place on a handle 201 of a weight 200. In preferred embodiments, one high end 101 of the grip 100 is substantially higher than a second low end 102 of the grip. This creates a sloping upper surface 103 between the two ends, causing a user's hands to rotate and change the position of the weight relative to the user, inducing a change in the way the muscles work or in which muscles are targeted when the weight is lifted and released. To achieve the slope, high end 101 may include substantially more material between the upper surface 103 and the receiver portion 105 than low end 102. Because the grip will tend to be used with heavy weights, a preferred embodiment is one in which the grip 100 is substantially solid. In such an embodiment, the grip may be comprised of rigid materials, such as plastics or woods, substantially rigid materials, such as more flexible plastics, foams, and silicones, or more flexible materials such as less dense silicones, foams, and plastics. However, if a particularly strong or compression-resistant material is used, it is possible that one embodiment of the grip 100 may be substantially hollow. In such an embodiment, the leading edge 104 may form a wall or supportive structure between upper surface 103 and receiver portion 105, and the rest of sides 106, upper surface 103, and receiver portion 105 may form a shell. Sides 106 include a left side wall 206 and a right side wall 207 each having an upper portion that is substantially vertical. The left side wall 206 and right side wall 207 each descend from the sloping upper surface 103. The grip 100 may include higher friction materials in its composition, on the upper surface 103, or in receiver portion 105, in order to increase the ability of a user to maintain hold of the grip, and/or to increase the hold the grip has on the handle 201 of the weight 200. Additionally, any or all of the external surfaces of the grip, such as the upper surface 103, receiver portion 105, or sides 106 may include hold enhancing features such as dimples, raised areas, lines or ridges, etc.

In some embodiments, grip 100 may be comprised of a single material element. In a further embodiment, the slope may be created by using a higher quantity of a substantially flexible material at high end 101 than low end 102. When the force of a user's grip causes the material to compress, high end 101, with more material, will still compress but remain relatively higher than low end 102. In such an embodiment, the receiver portion 105 may be substantially flexible and may simple slip around the handle 201, allowing the grip 100 to receive the weight 200. In a different further embodiment, the grip may be a more rigid material, such that the compressive force applied by a user's hand does not substantially distort the shape of the grip 100. In this embodiment, receiver portion 105 may be thin enough that the edges of the receiver portion can slip over the surface of the weight handle and snap into place. Alternatively, the grip 100 may be comprised of different materials, such that the grip maintains its shape by use of a rigid material, but the receiver portion 105 is a more flexible material coupled with the rest of the grip material.

The grip 100 may be formed such that the slope made by upper surface 103 is anywhere from 1° to 89° to the plane of the handle 201. However, in preferred embodiments, the slope will fall between 10° and 60° to the plane of the handle. The varying grip angles permit a user to customize the grip 100 for what the user hopes to achieve in that particular workout. In some embodiments, grip 100 may be stackable so that a user can individually customize the angle formed by the grip. For example, two 10° grips may be stacked to create an aggregate grip angle nearer to 20°.

Figure 2:
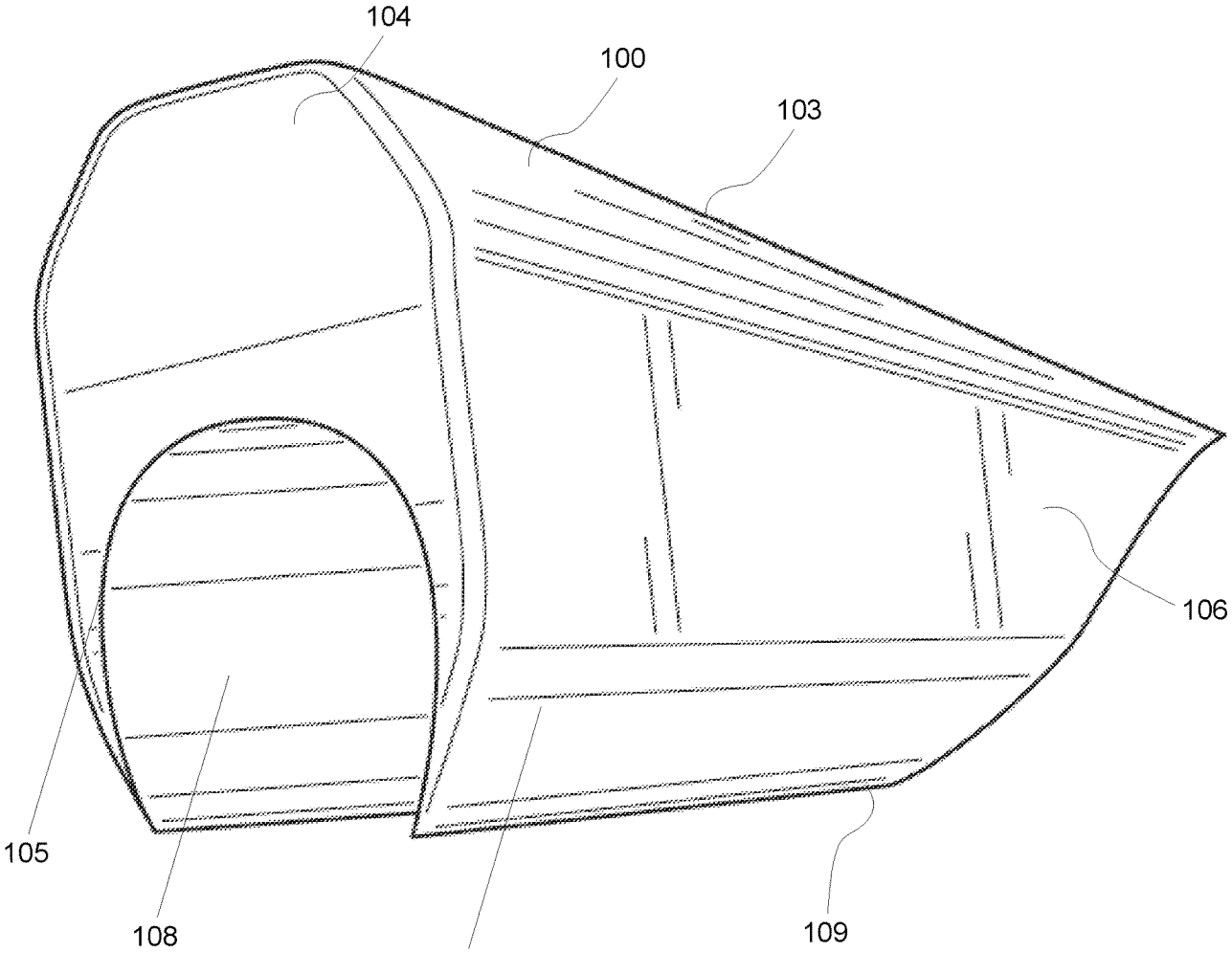
FIG. 2 is an isometric view of the WEIGHT GRIP.

Looking now to FIG. 2, receiver portion 105 is substantially curved and configured to receive a handle portion 201 of a weight 200. The receiver portion 105 will be substantially formed by an inside perimeter 108, which, in preferred embodiments, will be substantially solid. In some embodiments, inside perimeter 108 may include a surface preparation, such as dimpling or a high coefficient of friction material, in order to improve the griping surface between the grip 100 and the weight. Receiver portion 105 is further formed by sides 106 beginning to slope in toward the weight at portion 107. Portion 107 bends in toward the weight from the plane of sides 106, in addition to becoming thinner such that a user's fingers can bend naturally toward the weight handle. In one example, sides 106 are substantially parallel opposite sides joining the sloping upper surface 103 and the curved receiver portion 105, the sides 106 curving inward into the curved receiver portion 105 to partially form edges of the curved receiver portion 105. In use, a user's palm will be pressed against upper surface 103, and fingers and thumb will curve around the grip 100 and the weight, relying on portions 107 to taper to avow the natural curve of the fingers in a gripping position. Portions 107 terminate at lower edge 109, which forms the edge of grip 100 that will receive the handle of the weight and marks the boundary between portion 107 and insider perimeter 108.

Figure 3:
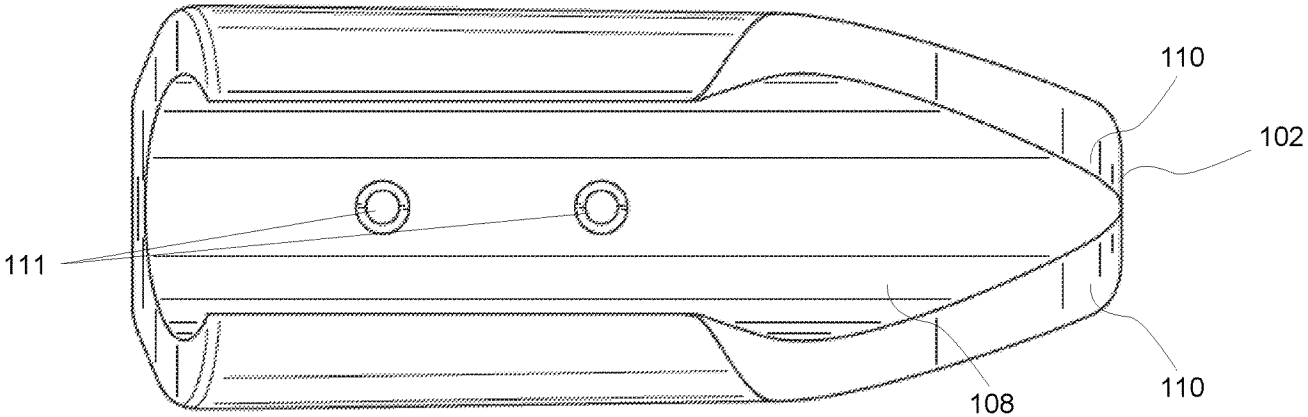
FIG. 3 is a bottom view thereof.
Figure 4:
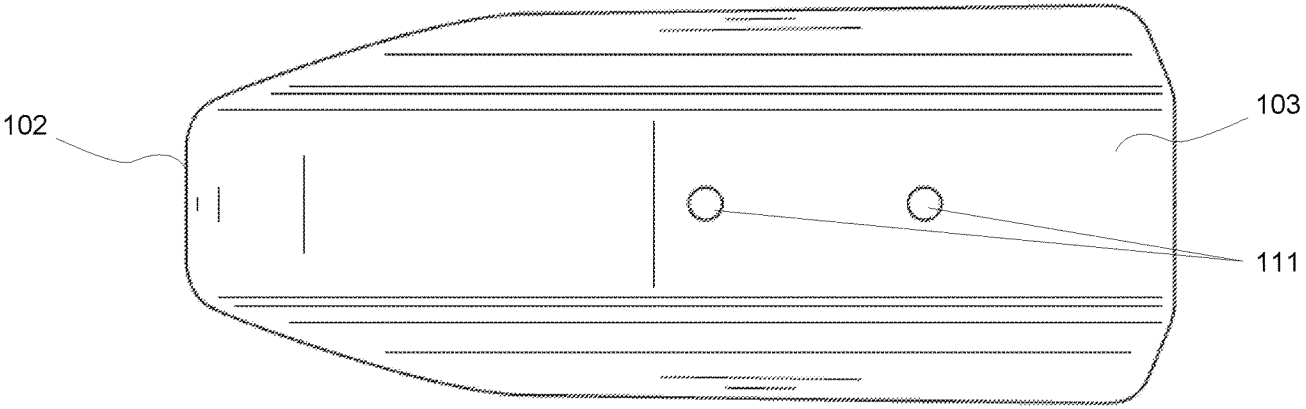
FIG. 4 is a top view thereof.

Turning now to FIG. 3, low end 102 is depicted as including a tapered edge 110. This tapered edge 110 aids the use of the grip 100 by further reducing the total material between the grip and the weight handle in a gradual manner. It is important for user comfort that the grip 100 taper as opposed to abrupt level changes, as a taper allows a user to maintain a more consistent grip. When lifting heavy weights, it is critical for a user to maintain control so as to not injure themselves or anyone around them. Edge 110 allows for a gradual reduction in grip material, regardless of the angle formed by edge 103 (not depicted, see FIGS. 1 and 2). FIGS. 3 and 4 also show magnets 111. In some embodiments, grip 100 may include one or more magnets 111 disposed on the upper surface 103, within the inside perimeter 108, or both. Since many weights are magnetically interactive materials, magnets 111 may be used to further increase the stability of the grip 100 by magnetically attracting the grip to the material of the weight. This helps both with keeping the grip 100 on the weight and with preventing the grip from rolling or sliding during use. While some embodiments may rely on the material and shape of the grip 100 to maintain a proper coupling with a weight, magnets 111 may be optionally including to further increase the stability of the grip in use.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A weight grip comprising:

a sloping upper surface the slope formed from a first high end to a second low end, the first high end being higher than the second low end;

a left side wall descending from the sloping upper surface;

a right side wall descending from the sloping upper surface;

a curved receiving portion substantially opposite the sloping upper surface, the curved receiving portion disposed between the left side wall in the right side wall; and wherein the left side wall and the right side wall join the sloping upper surface and the curved receiving portion, the left side wall and the right side wall each having an upper portion that is substantially vertical and a lower portion that curves inward such that they are thinner at a bottom edge than at the sloping upper surface.

2. The weight grip of claim 1, wherein the weight grip is substantially rigid.

3. The weight grip of claim 1, wherein the sloping upper surface comprises a compressible sloping upper surface configured to compress uniformly along the length of the slope from the first high end to the second low end, such that the weight grip maintains its shape even under compression from an external source.

4. The weight grip of claim 1, wherein the sloping upper surface, the curved receiving portion, and the left side wall and the right side wall-form an external perimeter of a solid device.

5. The weight grip of claim 1, wherein the sloping upper surface, the curved receiving portion, and the left side wall in the right side wall form an external perimeter of a hollow device.

6. The weight grip of claim 1, wherein the sloping upper surface comprises at least one magnet disposed within and flush to the sloping upper surface.

7. The weight grip of claim 1, wherein the sloping upper surface comprises at least two magnets disposed within and flush to the sloping upper surface, the at least two magnets being disposed substantially at one-thirds and two-thirds of the distance between the first high end and the second low end.

8. The weight grip of claim 1, wherein the curved receiving portion includes at least one magnet disposed within and flush to a surface of the receiving portion.

9. The weight grip of claim 1, wherein the curved receiving portion includes at least two magnets disposed within and flush to a surface of the receiving portion, the at least two magnets being disposed substantially at one-thirds and two-thirds of the distance between the first high end and the second low end.

10. The weight grip of claim 1, wherein the curved receiving portion substantially opposite the sloping upper surface is configured to receive at least a portion of at least one fitness weight handle.

* * * * *